US008297171B2

(12) United States Patent
Gagnon et al.

(10) Patent No.: US 8,297,171 B2
(45) Date of Patent: Oct. 30, 2012

(54) TORQUE LIMITER FOR A GUN TURRET

(76) Inventors: Ben Gagnon, Hesparia, CA (US); Thomas Gagnon, Hesparia, CA (US)

( * ) Notice: Subject to any disclaimer, the term of this patent is extended or adjusted under 35 U.S.C. 154(b) by 275 days.

(21) Appl. No.: 12/852,648

(22) Filed: Aug. 9, 2010

(65) Prior Publication Data

US 2012/0031261 A1 Feb. 9, 2012

(51) Int. Cl.
*F41H 7/00* (2006.01)

(52) U.S. Cl. ..... 89/36.13; 89/40.03; 74/814

(58) Field of Classification Search ..... 89/37.01, 89/40.03, 41.01; 74/814
See application file for complete search history.

(56) References Cited

U.S. PATENT DOCUMENTS

| | | | | | |
|---|---|---|---|---|---|
| 2,727,372 | A | * | 12/1955 | Haerther | 464/47 |
| 3,542,162 | A | | 11/1970 | Kerr | |
| 3,596,740 | A | | 8/1971 | Nau | |
| 3,653,226 | A | * | 4/1972 | Westbury | 192/18 R |
| 4,030,578 | A | * | 6/1977 | Cacciola et al. | 188/134 |
| 4,174,621 | A | * | 11/1979 | Woltjen | 464/36 |
| 4,176,733 | A | * | 12/1979 | Twickler | 188/134 |
| 4,286,441 | A | * | 9/1981 | Scheneman et al. | 464/36 |
| 4,311,224 | A | * | 1/1982 | Kato et al. | 192/56.5 |
| 4,898,265 | A | | 2/1990 | Metcalf | |
| 5,190,499 | A | | 3/1993 | Mori et al. | |
| 5,545,109 | A | * | 8/1996 | Hayakawa | 477/178 |
| 5,901,817 | A | * | 5/1999 | Gitnes | 188/134 |
| 6,099,433 | A | * | 8/2000 | Brouwer | 475/342 |
| 6,132,435 | A | * | 10/2000 | Young | 606/104 |
| 6,206,784 | B1 | * | 3/2001 | Kato | 464/36 |
| 7,467,576 | B2 | * | 12/2008 | Gao | 81/474 |
| 7,793,572 | B2 | * | 9/2010 | Hirt et al. | 81/473 |
| 8,161,849 | B2 | * | 4/2012 | Stark | 81/473 |
| 2006/0135267 | A1 | * | 6/2006 | Bosk | 464/43 |
| 2008/0136125 | A1 | * | 6/2008 | Hirt et al. | 279/103 |
| 2009/0116903 | A1 | * | 5/2009 | Causey et al. | 404/6 |
| 2010/0252387 | A1 | * | 10/2010 | Antchak et al. | 192/54.2 |
| 2011/0000347 | A1 | * | 1/2011 | Stark | 81/473 |
| 2011/0024140 | A1 | * | 2/2011 | De Bree | 172/21 |
| 2011/0184425 | A1 | * | 7/2011 | Cheraux | 606/104 |
| 2012/0031261 | A1 | * | 2/2012 | Gagnon et al. | 89/36.13 |

FOREIGN PATENT DOCUMENTS

JP 54102458 A * 8/1979

* cited by examiner

*Primary Examiner* — Michael Carone
*Assistant Examiner* — Joshua Freeman
(74) *Attorney, Agent, or Firm* — Kirk A. Buhler; Buhler & Associates

(57) ABSTRACT

Improvements in a torque limiter that uses a plurality of ball bearings that are retained in a cage. The ball bearings are compressed to create frictional drag on opposing flat plate surfaces. In some military vehicles the gun turret is rotated by personnel turning a crank that rotates the turret. The crank rotates a pinion or chain that turns the rack of the turret. When the turret does not move freely the personnel will typically apply more force that results in damaging the pinion, chain and or the rack. The torque limiter for a gun turret in this application connects between the crank and the drive train to allow the crank to turn without applying excessive torque forces on the pinion, chain and or the rack.

20 Claims, 4 Drawing Sheets

TORQUE LIMITER FOR A GUN TURRET

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in a torque limiter. More particularly, the present torque limiter uses a plurality of ball bearings that are retained in a ball cage and the ball bearings are compressed to create frictional drag on opposing flat plate surfaces.

2. Description of Related Art Including Information Disclosed Under 37 CFR 1.97 and 1.98

In some military vehicles the gun turret is rotated by personnel turning a crank that rotates the turret. The crank rotates a pinion or chain that turns the rack of the turret. When the turret does not move freely the personnel will typically apply more force that results in damaging the pinion, chain and or the rack. Repairing these components can be expensive and requires that the vehicle be taken out of service while the repair is being made. The torque limiter for a gun turret in the pending application connects between the crank and the drive train to allow the crank to turn without applying excessive torque forces on the pinion, chain and or the rack.

Several products and patents have been issued on ball bearing torque limiters without providing an acceptable solution. Exemplary examples of patents covering these products are disclosed herein.

U.S. Pat. No. 3,542,162 issued Nov. 24, 1970 to Richard H. Karr and U.S. Pat. No. 5,190,499 issued Mar. 2, 1993 to Keiji Mori et al both disclose torque limiting devices. In the case of '162 the torque limiter is for power transmission and the ball bearings roll in a recessed track. In the case of '499 the torque limiter is for an automobile mirror to prevent moving the mirror past a stop. The ball bearings are pressed with compression springs to maintain the desired torque limit. These patents do not operate to reduce the amount of force from a person turning a gun turret and all of the ball bearings follow the same track whereby the balls can create a single track.

U.S. Pat. No. 4,176,733 issued Dec. 4, 1979 to Robert G. Twickler discloses a combination no-back brake and torque limiter assembly. This assembly provides the dual function of a brake and a torque limiter. The ball bearings ride in a tapered track and depending upon the location of the ball(s) within the track, the amount of slip to the torque limiter is variable. As the ball moves higher in the track the torque amount is increased. This patent does not provide a constant torque limit without a braking function.

U.S. Pat. No. 4,898,265 issued to Jeffrey D. Metcalf on Feb. 6, 1990 discloses a torque limiter. This patent uses a series of springs that axially load the friction brake to limit the torque. While this patent discloses a torque limiter, the slipping of the torque limiter is through friction brakes that can create dust and debris that can cause future harm to the torque limiter and the torque limit is not transmitter through the ball bearings.

What is needed is a torque limiter that is designed for use by a manual operator and does not result in the generation of brake dust, debris or other contaminants. This application provides the solution where the friction is caused by compression of multiple ball bearings between two flat surfaces.

BRIEF SUMMARY OF THE INVENTION

It is an object of the torque limiter for a turret for the torque limiter to operate with axially aligned shafts. The axially aligned shafts allow the torque limiter to be retrofit into a crank of a gun turret. This allows for installation, removal and replacement by simply removing an existing manual crank and installing the torque limiter between the crank and the transmission that rotates the gun turret. Because of the installation, the torque limiter can receive significant side loading without failure.

It is an object of the torque limiter for a turret to utilize a plurality of ball bearings to transfer power between an input and an output shaft. The ball bearings are slightly compressed to frictionally grab opposing plates within the torque limiter. The ball bearing can roll on the plates where the ball bearings are held in a cage that allows the ball bearings to track in a variety of radii to reduce forming a track and abrading or galling the ball bearings.

It is an object of the torque limiter for a turret for the ball nearing to be pre-loaded against two parallel essentially flat plates. The amount of pre-load at least partially deforms the ball bearing and the flat plates. The deformation creates friction from rotation of the ball bearings on the flat plates. The amount of pre-loading affects the amount of torsion that is required for the ball bearings to freely turn. The pre-load is adjustable from minimal pre-load where the torque limiter is essentially free to spin as might be found with thrust bearings to a high level of pre-load that requires a high level of torsion to allow the axially aligned shafts to turn.

It is another object of the torque limiter for a turret to spin without generation of debris. The elimination of debris further eliminates wear surfaces that can require adjustment as the surfaces abrade or change their properties based upon the removal of material. While the torque limiter is not intended for a continuous slipping, the torsional slipping indicates that service of other components is required without causing harm to the non-torque limiting components located in the turret.

It is still another object of the torque limiter for a turret for the ball bearings to not ride within a ball track. A single ball track limits the number ball bearings that can be utilized and a ball track can be deformed over a period of time whereby altering the amount of torsion that is required to slip. The ball bearing cage places the ball bearings at various radii to ensure that the ball bearings roll over varying locations to minimize or eliminate the potential of the ball bearing creating a raceway or track.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
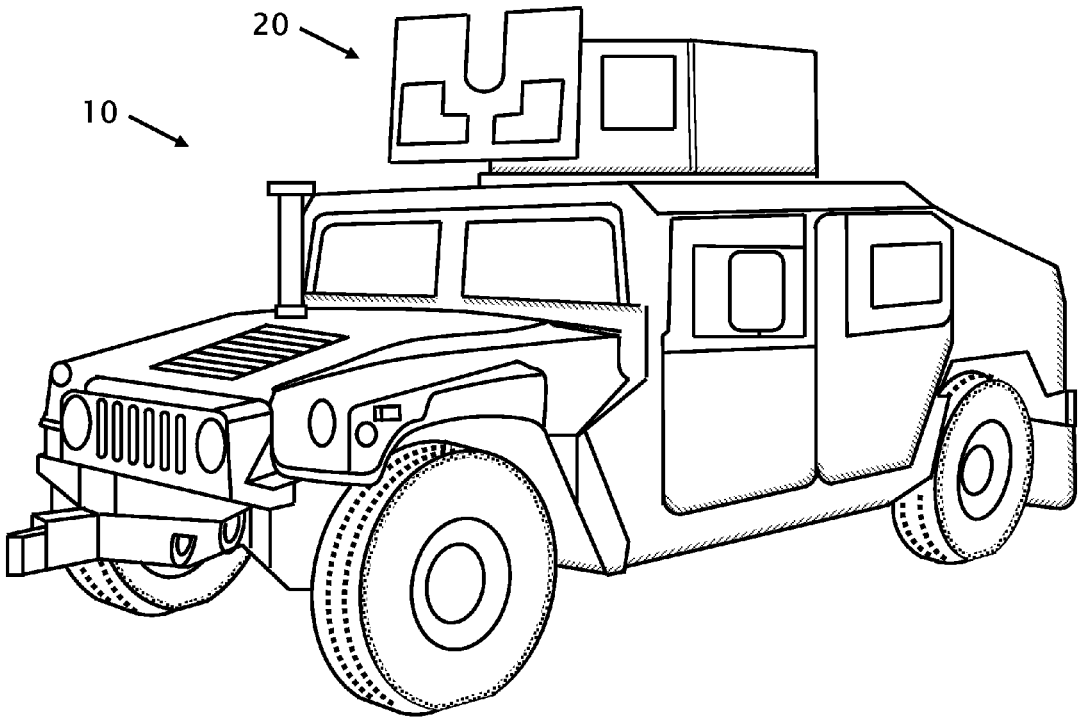
FIG. 1 shows a view of a military vehicle with a rotatable top turret.

FIG. 1 shows a view of a military vehicle 10 with a rotatable top turret 20. The turret 20 is manually rotated with a crank that is located within the military vehicle 10. Because the turret 20 is rotated manually a person turning the crank can exert as much force as they can to rotate the turret until either the turret 20 rotates or the rotational mechanism breaks. An internal view of the turret is shown and described in the preceding figures.

Figure 2:
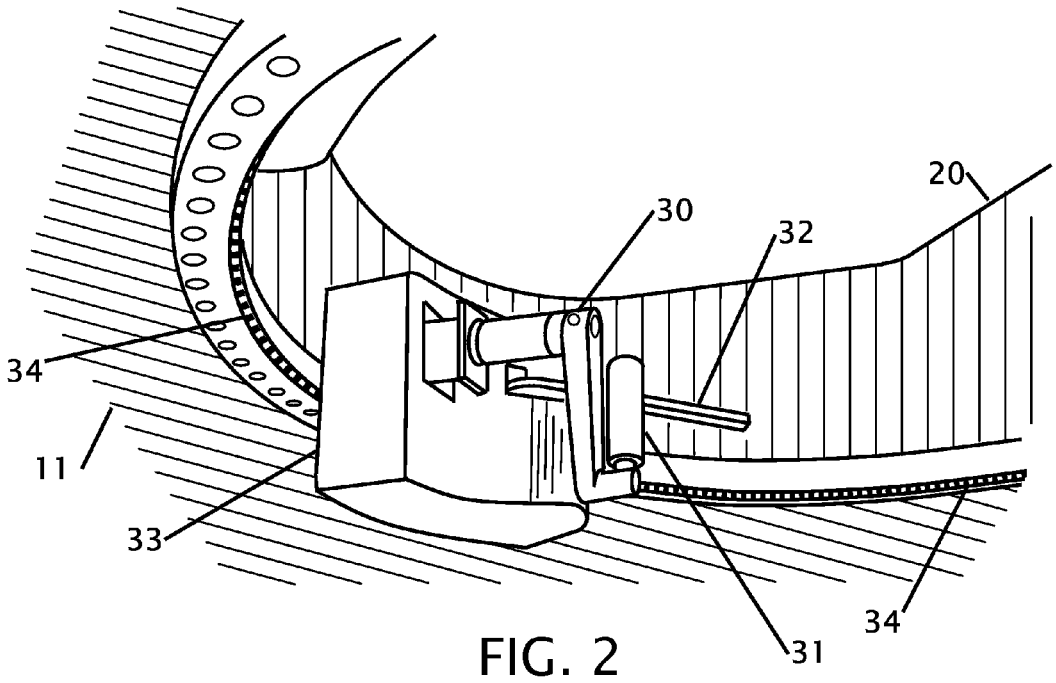
FIG. 2 shows a view of the rotatable top turret with the rotating mechanism.
Figure 3:
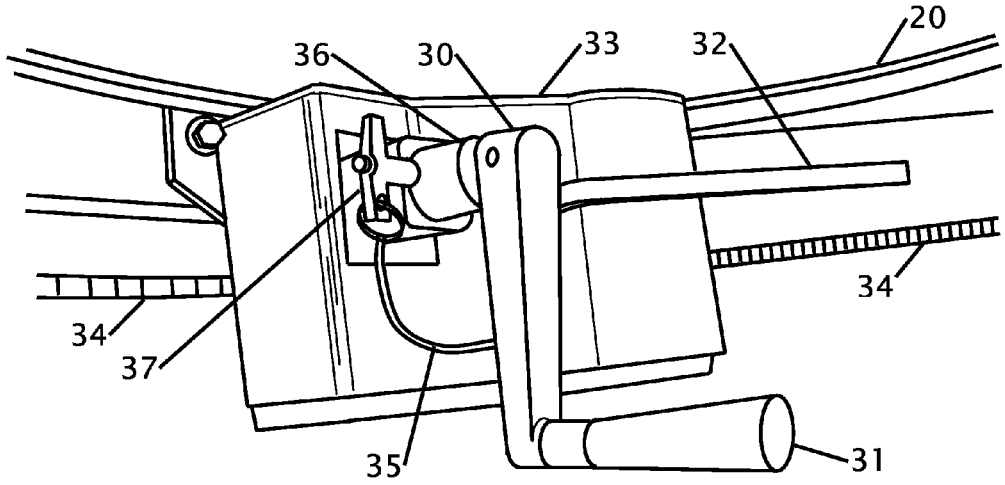
FIG. 3 shows a detailed view of the rotating mechanism showing the torque limiter installed.

FIG. 2 shows a view of the rotatable top turret with the rotating mechanism and FIG. 3 shows a detailed view of the rotating mechanism showing the torque limiter installed. These views are taken from the inside 11 of the military vehicle 10. From FIG. 2 the vertical portion of the turret 20 is shown rising from the central opening. To rotate the turret 20 the handle 31 is turned. In FIG. 2 the handle 31 is shown in a deployed orientation whereas in FIG. 3 the handle 31 is shown in a raised orientation. A tether 35 is connected to a removable retaining pin 37 that allows the handle 31 and the crank 30 to be completely removed from the transmission 33. The handle 31 pivots on the crank arm 30 to allow for more clearance through the turret 20 opening. When the crank 30 is rotated the rotation turns a shaft 36 that is connected to the transmission box 33.

The transmission box has a series or pulleys and gears that convert the turning of the crank 30 with rotational motion that turns the turret 20. The torque limiter is installed between the crank 30 and the transmission 33. The transmission 33 engages with a series of teeth 34 that are located in the rim of the turret 20. A handle 32 allows the operator to disengage the transmission from the drive teeth 34. The transmission is shown and described in more detail with FIG. 4 where the torque limiter is shown in an aligned orientation.

Figure 4:
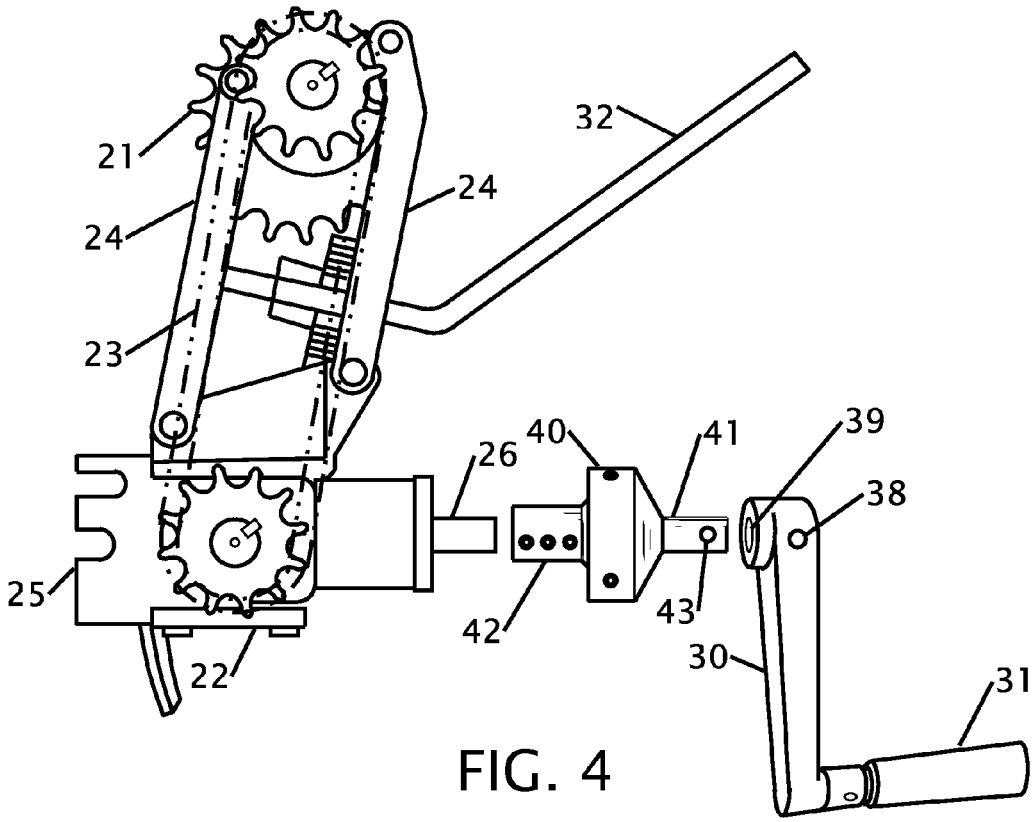
FIG. 4 shows the transmission that rotated the turret with the torque limiter installed.

FIG. 4 shows the transmission that rotated the turret with the torque limiter installed. The handle 31 is shown extended and connected to the crank 30. The crank 30 has an opening 39 to accept either the shaft 26 of the transmission, or the input shaft 41 of the torque limiter 40. The internal construction of the torque limiter 40 is shown and described in more detail with FIG. 6. The output shaft 42 of the torque limiter 40 is configured to match the output hole 39 in the crank 30. This allows the torque limiter 40 to be installed, removed, stored and replaced as the handle 30 would be installed or removed. The torque limiter 40 can then easily be retrofit onto and existing military vehicles and turrets or other similar arrangements. A set screw 38 in the handle 30 locks the crank 30 onto the torque limiter 40 with a corresponding recess 43 in the torque limiter 40.

The shaft 26 of the transmission enters into a gear box 22 that rotates the axis of rotation and then engages into a chain or similar drive 23 through a series of sprockets to turn the main sprocket 21 or pinion gear that is engageable into the rack 34 that is formed around the turret 20 (from FIGS. 2 and 3). An outside view showing the assembled torque limiter is shown in FIG. 5.

Figure 5:
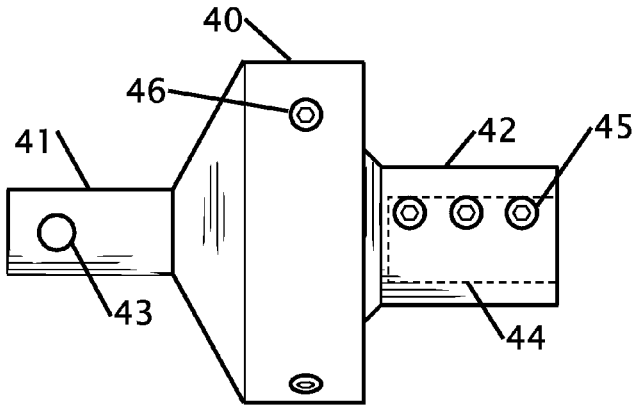
FIG. 5 shows an exterior view of the torque limiter in the preferred embodiment.

FIG. 5 shows an exterior view of the torque limiter in the preferred embodiment. The torque converter 40 has axially aligned input hole 44 and output shaft 41. Inside the body of the torque converter 40 is a series of ball bearing that connect the input shaft 41 with output hole 44 that is located within shaft 42. The input shaft 41 is sized similar or the same as the input shaft 26 on the transmission (as shown in FIG. 4). The same size shaft allows the torque limiter to be retro fit without any further modifications. The output hole 44, located within shaft 42, is sized similar or the same as the hole 39 that is found in the crank 30 (as shown in FIG. 4). The same size shaft allows the torque limiter to be retro fit without any further modifications. A series of set screws 45 are used to secure the torque converter onto the input shaft 26 of the transmission 40. A recess 43 located in the input shaft 41 allows the handle 30 (shown in FIG. 4) to be secured to the input shaft 41 with a sect screw or other securing mechanism. A series of set screws 46 that are located around the periphery of the torque limiter 40 secures the torque limiter together. The mechanism that secures the input shaft 41 to the output hole 44 of the torque limiter is shown and described in more detail.

Figure 6:
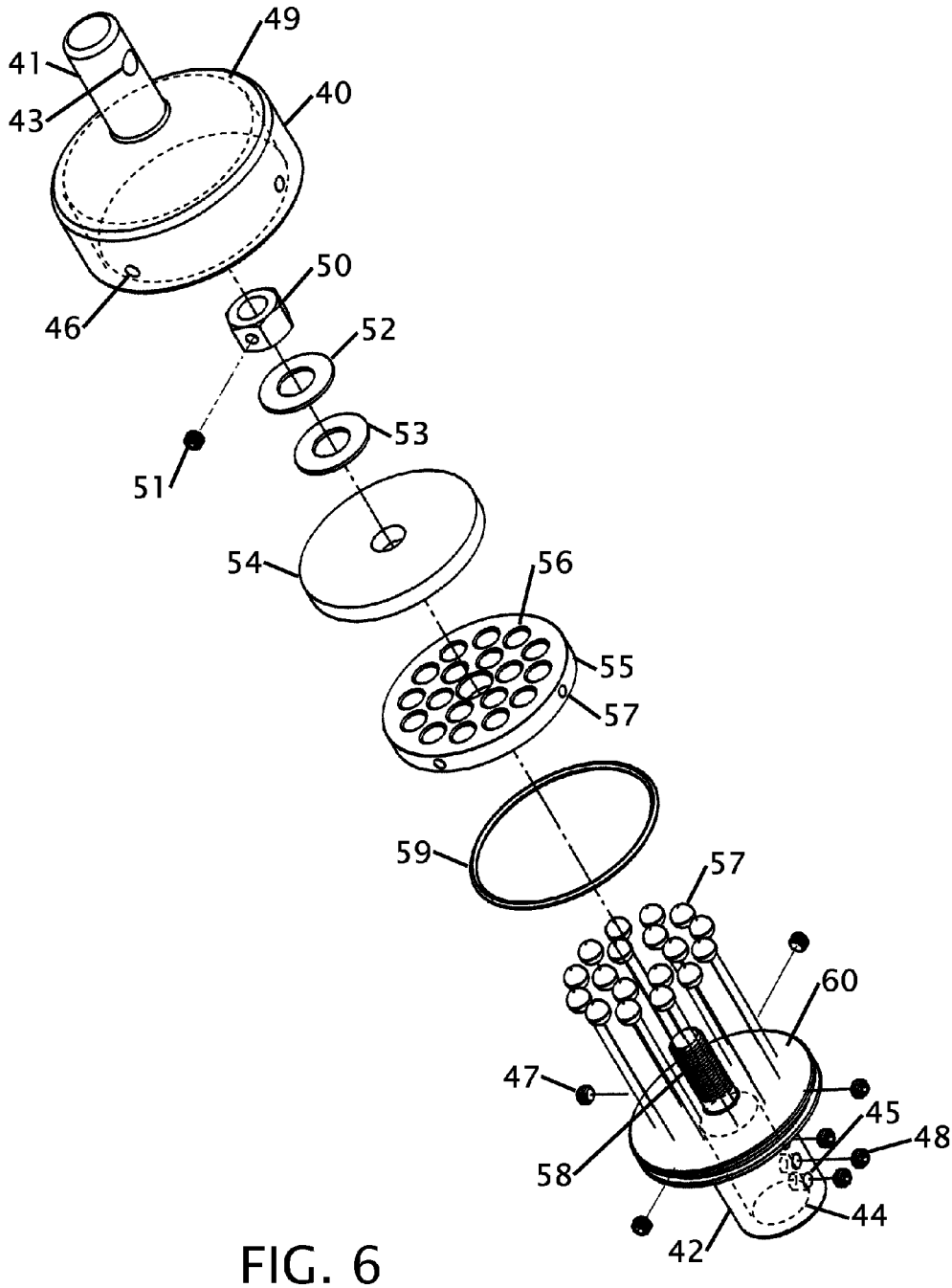
FIG. 6 shows an exploded view of the torque limiter showing the internal components.

FIG. 6 shows an exploded view of the torque limiter showing the internal components. The input shaft 41 has a recess 43 for securing the crank 30 as shown and described with FIG. 4. The input shaft 41 has a flat bearing surface 54 located on the opposite side of the input shaft 41. An output shaft 42 that is axially aligned with the input shaft, having a recessed hole 44 and having a flat bearing surface 60 located on the opposite side of the output shaft 42. A plurality of ball bearings 57 are located between the flat surface 54 of the input shaft 41 and the flat surface 60 of the output shaft 42. The torque limiter has a ball cage 55 with a plurality of holes 56 to accept the ball bearings. The ball cage locates and retains the ball bearing 57 between the flat surface 49 of the input shaft 41 and the flat surface 60 of the output shaft 42. In the preferred embodiment the ball cage 55 provides holes for 18 ball bearings, but it is contemplated that as few as three ball bearings too many more than three ball bearings can be used. The ball bearings are placed at the same or different radii to minimize the ball bearing forming a track in either flat plate 54 or 60.

An elongated securing shaft 58 extends between the flat surface 54 of the output shaft 44 and the flat surface 54 of the output shaft 41 for securing the ball cage 55. The elongated shaft 58 is being secured to the disk 54 with an adjustment nut 50. The nut 50 is retained on position on the elongated shaft with threads and a set screw 51. The torque is adjusted with the adjustment nut 50 to alter the frictional torque that is transmitted between the input shaft 41 and the output shaft 42.

A securing mechanism, such as set screws 47, are placed through holes 46 in the bell of the input shaft where they engage into the recesses 62 in the ball cage 55 to secure the input shaft 41 to the output shaft 42 whereby the input shaft 41 and the output shaft 42 can rotate in synchronous rotation and separately from each other.

A series of washers 52 and 53 absorb frictional wear rotation when the input shaft 41 and the output shaft 42 or not turning in unison. A series of screws 48 engage through holes 45 to secure the torque limiter onto the input shaft of the transmission 26 as shown in FIG. 4.

The input shaft is connected to a bell shaped housing that has an internal cavity 49 for the ball bearings 57 the ball cage 56 and the remaining components to be retrained. A sealing gasket 59 or ring seals the internal mechanism of the torque limiter from debris and contaminants.

In the figure shown the adjustable shaft is shown extending from the output shaft 42 but it is also contemplated that the assembly can be constructed in the reverse arrangement.

Thus, specific embodiments of a torque limiter for a turret have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A torque limiter for a turret comprising:

an input shaft having a flat bearing surface located on the opposite side of said input shaft;

an output shaft that is axially aligned with said input shaft and having a flat bearing surface located on the opposite side of said output shaft;

a plurality of ball bearing located between said flat surface of said input shaft and said flat surface of said output shaft;

a ball cage that locates and retains said ball bearing between said flat surface of said input shaft and said flat surface of said output shaft;

an elongated securing shaft that extends between said flat surface of said input shaft and said flat surface of said output shaft for securing said ball cage;

said elongated shaft being secured with an adjustment nut whereby said adjustment nut can be adjusted to alter the frictional torque that is transmitted between said input shaft and said output shaft, and a securing mechanism that secures said input shaft to said output shaft whereby said input shaft and said output shaft can rotate in synchronous rotation and separately from each other.

2. The torque limiter for a turret according to claim 1 wherein said elongated securing shaft extends from said input shaft.

3. The torque limiter for a turret according to claim 1 wherein said elongated securing shaft extends from said output shaft.

4. The torque limiter for a turret according to claim 1 wherein said input shaft is forms into a bell housing.

5. The torque limiter for a turret according to claim 4 wherein said securing mechanism that secures said input shaft to said output shaft is with removable fasteners that extend from said bell housing into said output shaft.

6. The torque limiter for a turret according to claim 1 wherein output shaft forms into a bell housing.

7. The torque limiter for a turret according to claim 6 wherein said securing mechanism that secures said input shaft to said output shaft is with removable fasteners that extend from said bell housing into said input shaft.

8. The torque limiter for a turret according to claim 1 wherein said input shaft is secured to said ball cage.

9. The torque limiter for a turret according to claim 1 wherein said output shaft is secured to said ball cage.

10. The torque limiter for a turret according to claim 1 that includes at least three ball bearings.

11. The torque limiter for a turret according to claim 1 wherein said ball bearings exist in at least two different radii.

12. The torque limiter for a turret according to claim 1 wherein said torque limit is adjustable by altering the compression placed on said ball bearing.

13. The torque limiter for a turret according to claim 1 wherein said securing shaft is threaded.

14. The torque limiter for a turret according to claim 1 that further includes a wear plate that engage said ball bearings.

15. The torque limiter for a turret according to claim 14 that further includes at least one wear washer located between said wear plate and said adjustment nut.

16. The torque limiter for a turret according to claim 15 wherein said wear plate is secured with said adjustment nut to said input shaft.

17. The torque limiter for a turret according to claim 15 wherein said wear plate is secured with said adjustment nut to said output shaft.

18. The torque limiter for a turret according to claim 1 that further includes a sealing ring or sealing gasket.

19. The torque limiter for a turret according to claim 1 wherein said output shaft further includes a recess.

20. The torque limiter for a turret according to claim 19 wherein said output shaft further includes at least one set screw.

* * * * *